US005275029A

United States Patent [19]

Myers

[11] Patent Number: 5,275,029

[45] Date of Patent: Jan. 4, 1994

[54] REFRIGERATOR DOOR LOCK

[75] Inventor: Gary L. Myers, River Grove, Ill.

[73] Assignee: Fort Lock Corporation, River Grove, Ill.

[21] Appl. No.: 912,514

[22] Filed: Jul. 13, 1992

[51] Int. Cl.[5] ..... E05B 65/06

[52] U.S. Cl. ..... 70/128; 292/60; 411/549; 70/432; 70/DIG. 59; 70/DIG. 79

[58] Field of Search ..... 70/128, 449, 432, DIG. 13; 70/DIG. 59; 292/DIG. 71; 292/59; 292/60; 292/DIG. 38; 71/57; 70/36.0; 70/DIG. 79; 70/414; 70/388; 411/343, 549; 312/236

[56] References Cited

U.S. PATENT DOCUMENTS

| | | | |
|---|---|---|---|
| 2,204,053 | 6/1940 | Dart | 292/61 |
| 2,783,617 | 3/1957 | Halovatch | 292/DIG. 71 |
| 3,661,001 | 5/1972 | Glass | 70/388 |
| 4,106,317 | 8/1978 | Anderson | 70/388 |
| 4,490,999 | 1/1985 | Castle et al. | 70/432 |
| 4,648,637 | 3/1987 | Walter | 292/DIG. 71 |
| 4,744,392 | 5/1988 | Tade, III et al. | 292/59 |
| 4,895,400 | 1/1990 | Harding et al. | 292/DIG. 38 |
| 4,899,561 | 2/1990 | Myers | 70/208 |
| 4,907,716 | 3/1990 | Wankel et al. | 70/360 |

FOREIGN PATENT DOCUMENTS

| | | | |
|---|---|---|---|
| 7191 | of 1907 | United Kingdom | 70/388 |

*Primary Examiner*—Peter M. Cuomo
*Assistant Examiner*—Darnell M. Boucher
*Attorney, Agent, or Firm*—Leydig, Voit & Mayer

[57] ABSTRACT

An improved refrigerator door-locking device is provided for locking a refrigerator door to a refrigerator body which may preferably be manufactured substantially of molded plastic parts. The locking device has an elongated first mountable casing which has an elongated opening, and a plunger member which has a projecting rod end and slotted outer rod end slidably fits within the opening. A bayonet connector is located at the projecting rod end of the plunger and a spring biases the plunger toward the projecting rod end. A bayonet receiver is located in a second mountable casing and interacts with the projecting rod end bayonet connector. The locking device provides a visual indication of when it is locked or unlocked.

20 Claims, 3 Drawing Sheets

REFRIGERATOR DOOR LOCK

FIELD OF THE INVENTION

The present invention is generally directed toward mechanical locks and more particularly relates to improvements in refrigerator door locks.

BACKGROUND OF THE INVENTION

Locks for locking a refrigerator or freezer door are old in the art, and generally involve a locking member attached to the open end of the door and a lock receiving member attached to the refrigerator/freezer body and aligned with the locking member. The locking member is typically a hook and the receiving member is typically a bar to which the hook interacts. Typically means such as a spring are included to extract a key which might be inadvertently left in the lock.

General Electric upright freezer model no. CA21DPC utilizes a freezer door lock including a locking member located inside the outer edge of the open side of the refrigerator door and a receiving member located within the body of the door in alignment with the locking member. The locking member has a rotatable latch which interacts with a bar located in the refrigerator body in the receiving member. The locking member has a input stem with a external spline surrounded by a outwardly spring biasing member. A key utilizing an internal spline is matingly engaged with the input stem. The key interacts with the spring biasing member of the locking member which ejects the key from the lock if it is inadvertently left in the lock.

The above refrigerator door locks do not adequately prevent a child from being inadvertently locked into the freezer.

The above refrigerator door locks are also subject to damage if the door is closed when the lock is left in an open position.

Prior art refrigerator door locks are prone to damage when an attempt is made to open the door when the door is unknowingly locked.

Further, the above refrigerator door locks do not provide an accommodation for the door and the body of the freezer when the resiliency of the plastic door seal varies with temperature.

Also, the above refrigerator door locks do not encompass a sufficient locking action to properly pull the door toward the body of the refrigerator.

Prior art refrigerator door locks are constructed internally to the door and the body of the freezer and as such are not suitable for retrofit or repair of an existing refrigerator lock.

Prior art refrigerator door locks have keys made of a soft ductile material with an internal spline which keys may prematurely wear.

The present invention is directed toward overcoming one or more of the problems discussed above.

OBJECTS OF THE INVENTION

It is the primary object to provide a relatively simple and inexpensive locking device for refrigerators/freezers which eliminates the likelihood of inadvertently locking the freezer with a child trapped therein.

Another object of the invention is to provide a locking device which avoids possible damage to the lock if the door is shut with the door in a locked position.

In this connection, it is another related object of the invention to also avoid possible damage to the lock caused by forcing a locked door open when one is not cognizant that the door is locked.

A further object of the invention is to provide a locking device which can accommodate the affects of temperature variations of the refrigerator door and seal.

Yet another object of the invention is to provide a locking device which maintains the integrity of the sealing of the door when the lock is locked.

Still another object of the invention is to provide a refrigerator lock which may be easily repaired or replaced.

Yet another object of the invention is to provide a refrigerator door lock which may be refitted onto a refrigerator which either does not have a refrigerator lock or has an internal one which is not easily repaired.

A further object of the invention is to provide a refrigerator door lock which utilizes a key that is durable and not prone to premature failure.

Other objects and advantages of the lock of the present invention will become apparent as the following description proceeds taken in connection with the accompanying drawings.

BRIEF SUMMARY OF THE INVENTION

In accomplishing these and other objects of the invention, there is provided a refrigerator door locking device which preferably may be manufactured almost entirely of molded plastic parts comprising an elongated first mountable casing having a longitudinal opening. A plunger member with a projecting rod end is slidingly fit within the longitudinal opening. A bayonet connector is located at the rod end. A spring urges the plunger toward the rod end. The refrigerator door locking device also comprises a second mountable casing which serves as a catch. The second casing includes a pair of matching openings to matingly engage the bayonet connector.

By providing a locking device which has a spring located between the plunger and the outer rod end of the first casing, the first mountable casing is urged toward the second mountable casing. The spring supplies a force which causes the first and second casing to move together thereby insuring the proper integrity of this seal when temperature variations change the resiliency of the seal.

By providing a first mountable casing and a second mountable casing, the locking device may be externally installed on a refrigerator by mounting one of the mountable casings to the refrigerator and the other mountable casing to the refrigerator body. Thus a refrigerator door locking device is provided which is suitable for retrofit or repair.

In a preferred embodiment to this aspect of the invention, the locking device also includes an indicator for visually indicating the locked or unlocked state of the locking device. By viewing the indicator, the door does not need to be opened until the indicator shows that the door is in the unlocked position. This feature avoids damage to the lock by attempting to force open a locked door.

In a second aspect of this invention, a refrigerator door locking device includes an elongated first mountable casing which has a longitudinal opening. A plunger which has a projecting rod end an outer rod end is slidably fit through the opening. A bayonet connector is located at the end of the projecting rod and a spring urges the plunger toward the projecting rod end. The locking device also has a second mountable casing which serves as a catch. The catch casing receives the bayonet connector. The plunger has pop out means for providing axial displacement of the plunger if the door is closed when the plunger member is in a locked position and has a preferred embodiment in which the pop out means is provided by permitting the outer rod end to be extendable through the longitudinal opening of the first casing. The pop out means permits the outer rod end of the plunger to extend through the second casing when the door is shut in the locked position rather than damaging the bayonet connector or the second casing. This feature avoids damage to the lock when shutting a door with a lock in the locked position.

In a preferred embodiment of this aspect of the invention the locking device further includes an ejector for ejecting a key from the locking device. In a preferred embodiment of this aspect of the invention, the ejector comprises a washer located between the spring in the first casing and slidably fits over the outer rod end of a plunger. The first casing has an opening to receive the outer rod end of the plunger. The casing opening is larger than the washer opening in order that a tubular key may fit into the casing opening and seat against the washer. The spring cooperates with the washer to eject the key. The use of the ejector prevents the key from being inadvertently left in the lock. The inability of the key to be left in the lock reduces the likelihood of a child inadvertently locking the freezer with a child inside the freezer.

As a third aspect of this invention a refrigerator door locking device includes an elongated first mountable casing which has a longitudinal opening and a plunger which has a projecting rod end and a outer rod end. The plunger slidably fits into the opening and a bayonet connector is located at the projecting rod end. A spring urges the plunger toward the projecting rod end. The locking device also includes a second mountable casing which serves as a catch. The second casing includes a mutually engageable means, which is designed to mate with the bayonet connector. The locking device also has a puller associated with the second casing which pulls the plunger toward the catch upon rotation of the plunger. In a preferred embodiment of this aspect of the invention, the puller is a rotary cam located on the second casing. The cam serves to position the door properly against the seal and maintain the seal of the door reducing the likelihood of air leaks between the seal and the door.

While the invention will be described with certain preferred embodiments, there is no intent to limit it to these embodiments. On the contrary, the intent is to cover all alternatives, modifications, and equivalents included in the spirit and scope of the invention as defined by the appended claims.

DESCRIPTION OF THE PREFERRED EMBODIMENT

Figure 1:
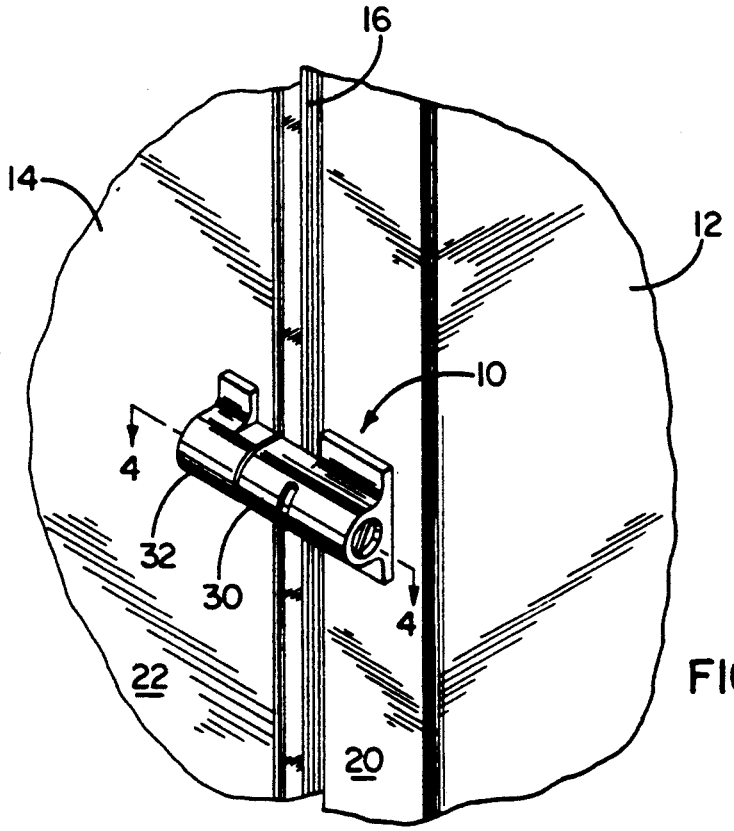
FIG. 1 is a fragmentary perspective view of a first embodiment of the present invention mounted on a refrigerator door shown in the closed position.

Turning now to the drawings, there is shown in FIG. 1 a freezer/refrigerator door-locking device 10. The door-locking device 10 is used to secure a freezer/refrigeration door 12 against a freezer/refrigerator body 14. In the closed position a door seal 16 which is typically attached to the door 12 is partially compressed. The door-locking device 10 may be mounted to an end face 20 of the refrigerator door 12 and to an end face 22 of the refrigerator body 14 as shown in FIG. 1. Other mounting configurations for the door-locking device 10 whereby the door-locking device 10 may secure the door 12 to the refrigerator body 14 may be employed included placing the door-locking device 10 internally in the door 12 and the refrigerator body 14 or by incorporating the door-locking device 10 into a door handle (not shown).

Figure 2:
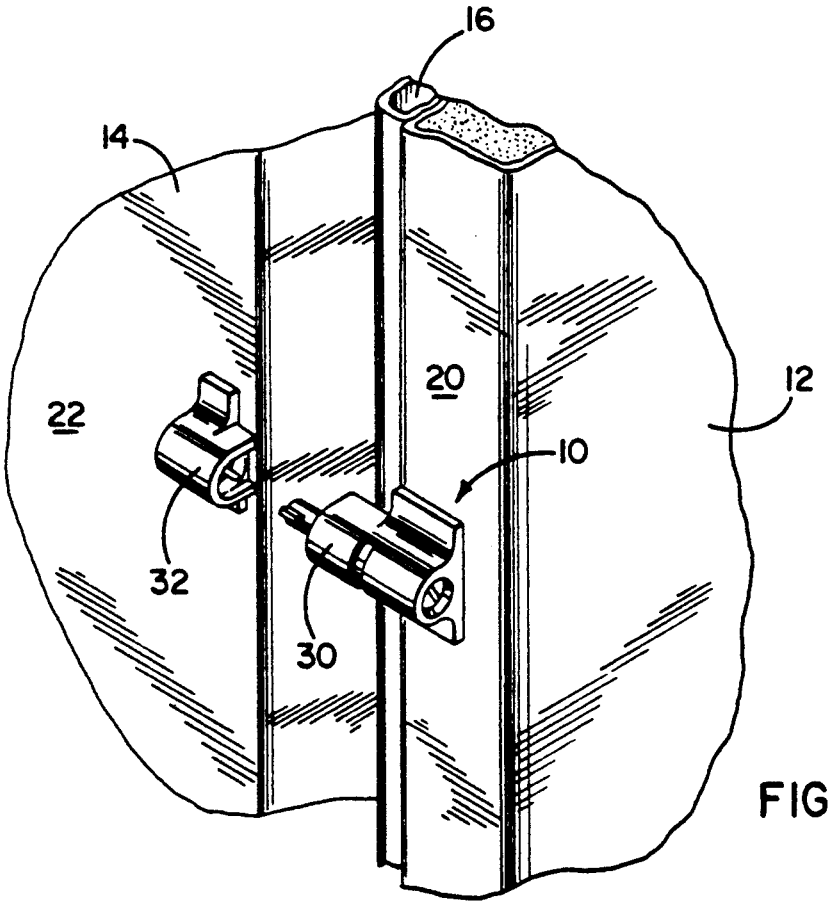
FIG. 2 is a fragmentary perspective view of the first embodiment of the present invention mounted on a refrigerator and shown in the open position.

Referring to FIG. 2 which shows the refrigerator door-locking device 10 with the door 12 in an open position, the door-locking device 10 includes an elongated first mountable casing 30 and a catch means second mountable casing 32. The elongated first mountable casing 30 is typically secured to the end face 20 of the door 12, and the catch casing 32 is secured to the end face 22 of the refrigerator body 14. Reversing the location of the elongated first mountable casing 30 and the second casing 32 may be a possible variation of this invention.

Figure 3:
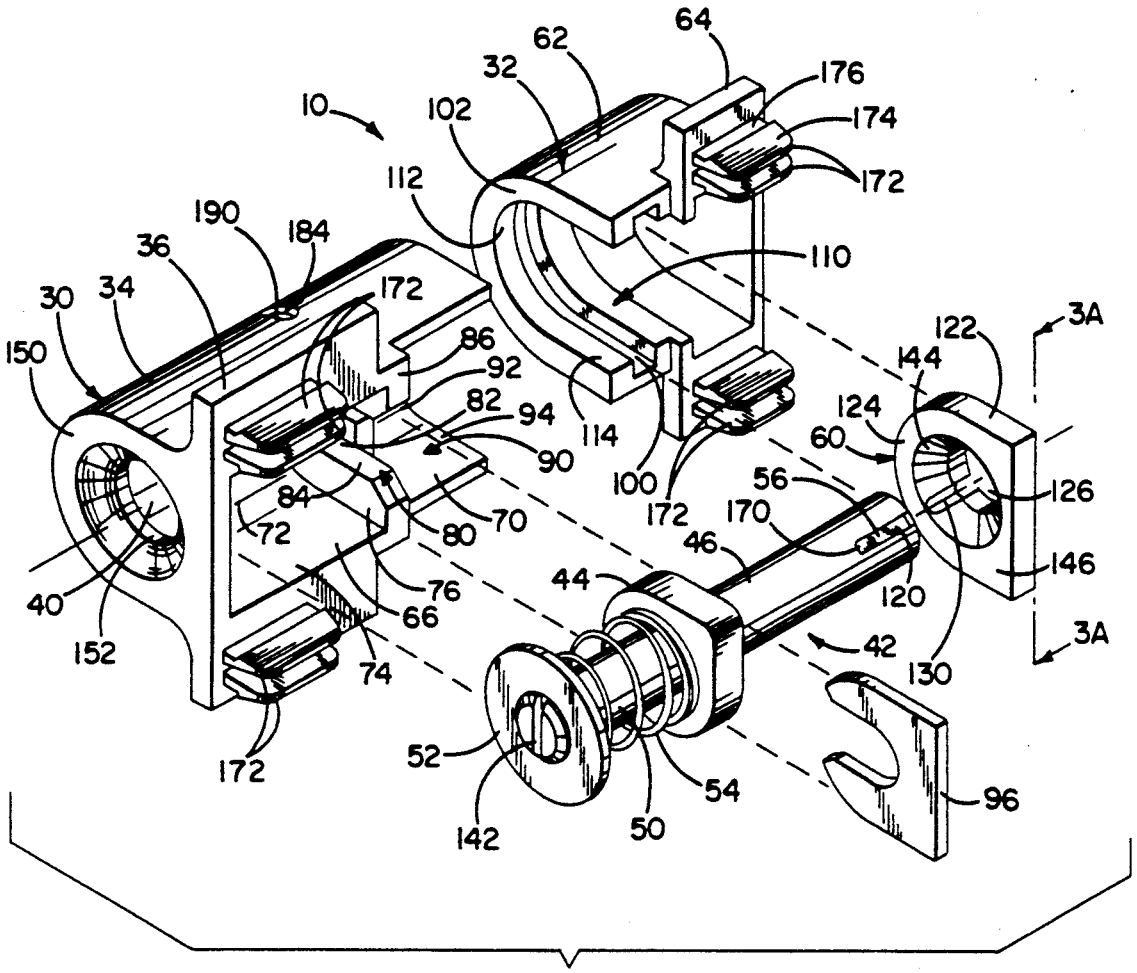
FIG. 3 is an exploded perspective view of a first embodiment of the present invention.

Now referring to FIG. 3, the door-locking device 10 includes the elongated first mountable casing 30, which may be of any suitable configuration but a preferred exemplary embodiment includes a cylindrical housing 34 and a rectangular planar base 36. The housing 34 has a centrally located longitudinal opening 40 through which a cylindrical plunger member 42 is slidably fit. The plunger member 42 has a centrally located disk 44, a projecting rod end 46 extending from the disk 44 in a first direction and an outer rod end 50 extending from the disk 44 in the opposite direction. A washer 52 is slidably fit about the outer rod end 50 and spring means 54 are located between the washer 52 and the disk 44. The projecting rod end 46 has bayonet connector means 56 which cooperate with mutually engageable means 60 which are located in the second mountable casing 32. The second mountable casing 32 has a cylindrical housing 62 and a rectangular planar base 64.

In order to provide for an easy assembly of the door locking device 10, the elongated first mountable casing 30 has a forward central cavity 66 and a rearward central cavity 70. The forward central cavity 66 has a cylindrically shaped upper portion 72 which adjoins a rectangularly shaped lower portion 74. The disk 44 slidably passes through the lower rectangular portion 74 and matingly fits with the cylindrically shaped upper portion 72. The plunger member 42 may thereby be assembled into the elongated first mountable casing 30 by merely loading the plunger member 42 from the base 36 of the elongated first mountable casing 30.

In order to assist in the support of the plunger member 42, a first planar tombstone 76 separates the forward central cavity 66 from the rearward central cavity 70. The first tombstone 76 has an aperture 80 which has a semicircular upper portion 82 which matingly fits the projecting rod end 46 of the plunger member 42 and a lower rectangular portion 84 which is in clearance with the projecting rod end 46. A second tombstone 86 is located in the rearward central cavity 70 and has an aperture 90 with a semicircular upper portion 92 and a rectangular lower portion 94. The first tombstone 76 and the second tombstone 86 provide access from below the base 36 for the installation of the plunger member 42. The first tombstone 76 and the second tombstone 86 also serve as guides and supports for the axial motion of the plunger member 42.

In order to seat the plunger member 42 against the semicircular upper portion 82 of the first tombstone 76 and the semicircular upper portion 92 of the second tombstone 86, a U-shaped plate 96 is preferably inserted from the base 36 of the elongated first mountable casing 30 into the forward central cavity 66 against the first tombstone 76. The plunger member 42 is thereby secured into the elongated first mountable casing 30. The forward central cavity 66 provides means for the disk 44 of the plunger member 42 to move axially in order to assist in the locking of the plunger member 42 into the mutually engageable means 60.

Although the mutually engageable means 60 could be molded as a part of the second mountable casing 32, preferably, the catch means second mountable casing 32 has an internal groove 100 which is parallel to and spaced inwardly from an outer face 102 of the second mountable casing 32. In order to receive bayonet connector means 56 and the projecting rod end 46 as well as to receive the mutually engageable means 60, the second mountable casing 32 has an aperture 110 which has a cylindrically shaped upper portion 112 and a rectangularly shaped lower portion 114. Mutually engageable means 60 preferably are separable from the second mountable casing 32 to assist fabrication. Mutually engageable means 60 are inserted from the lower portion 114 of the aperture 110 into the internal groove 100 of the second casing 32.

There are many conceivable designs of bayonet connector means 56 and mutually engageable means 60 that interconnect the same which may fall within the scope of this invention. Preferably, bayonet connection means 56 comprise two diametrically opposed longitudinally elongated ears 120 extending from the projecting rod end 46 of the plunger member 42. Mutually engageable means 60 preferably have an outer planar portion 122 and an inner cylindrical portion 124. Mutually engageable means 60 have a centrally located opening 126 which is generally perpendicular to the planar portion 122. Extending from the opening 126 are two diametrically opposed slots 130 through which the ears 120 matingly slide.

In order to operate the locking device 10, the door 12, shown in the open position in FIG. 2, is closed until the door 12 is against the refrigerator body 14 as shown in FIG. 1. The projecting rod end 46 is slid into the opening 126 with the ears 120 which are aligned with the slots 130 and the mutually engageable means 60 until the door seal 16 is compressed against the refrigerator body 14 as shown in FIG. 1.

Figure 3A:
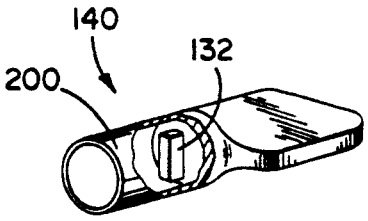
FIG. 3A is a perspective view of a key to be utilized with the present invention.

Referring to FIG. 3A, at this point a blade 132 of key 140 is inserted into a centrally located transversely elongated key slot 142 located in the distal end of the outer rod end 50 of the plunger member 42. Again referring to FIG. 3, the key 140 is pushed against the plunger member 42 until the disk 44 seats against the U-shaped plate 96. It may be necessary to simultaneously push against the door 12 in order to compress the door seal 16. At this point the key 140 is rotated clockwise thereby correspondingly rotating the plunger member 42 clockwise. The ears 120 also are rotated clockwise and away from the opposed slots 130 thereby completing the locking procedure.

In order to guide the projecting rod end 46 of the plunger member 42 into the opening 126 of the mutually engageable means 60, the mutually engageable means 60 preferably have contoured walls or a chamfer 144 which is located on an outer face 146 of the mutually engageable means 60 and which is concentric with the opening 126. The chamfer 144 guides the projecting rod end 46 into the opening 126.

Preferably, to insure that the ears 120 of the projecting rod end 46 are completely through the opposed slots 130 of the mutually engageable means 60 when the door 12 is fully closed, the key slot 142 is simply rotated. This is accomplished by having the spring means 54 be a metal coil spring which surrounds the outer rod end 50 and which is located between the washer 52 and the disk 44. The spring means 54 push the disk 44 and consequently the plunger member 42 rearwardly until the disk 44 seats against the U-shaped plate 96 resulting in the plunger member 42 being in its most rearward position. The ears 120 have completely passed through the opposed slots 130 when the plunger member 42 is completely rearward. The key slot 142 must thereby merely be rotated by the key 140 in order to accomplish the locking procedure. This feature negates the need to push on the door 12 to compress the door seal 16 when locking the door 12.

In order to avoid damage to the ears 120 of the plunger member 42 in the event that the door 12 is shut when the door locking device 10 is left in a locked position while the door 12 is being closed, an outer face 150 of the elongated first mountable casing 30 has a casing opening 152 which is larger than the outer rod end 50 of the plunger member 42. The casing opening 152 is in alignment with the outer rod end 5 permitting the outer rod end 50 to pass through the casing opening 152. If the door 12 is closed when the door locking device 10 in a locked position, rather than breaking or shearing the ears 120, the plunger member 42 moves forwardly compressing the spring means 54. The outer rod end 50 extends through the casing opening 152 thereby permitting the closing of the door 12 without causing any damage to the plunger member 42.

Figure 3B:
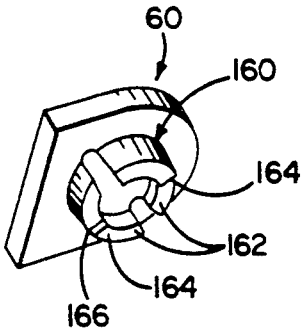
FIG. 3B is a perspective view taken along line 3B—3B of FIG. 3.

Referring FIG. 3B, in order to more tightly and effectively seal the door seal 16 of the door 12 against the refrigerator body 14, the inner cylindrical portion 124 of the mutually engageable means 60 has a ring-shaped cam 160. Preferably the cam 160 consists of two axially increasing rotary inclined surfaces 162 which have a minimum axial dimension at the opposed slots 130 and the axial dimension increases in a clockwise direction from the opposed slots 130 when viewed as shown in FIG. 3.

Again referring to FIG. 3B, the inclined surfaces 162 each have an axially extending wall 164 located at the high point of the inclined surfaces 162 to stop further rotation of the plunger member 42. In order to keep the plunger member 42 in this locked position, the inclined surfaces 162 also have dips 166 near the walls 164 which dips 166 conform to the shape of the ears 120. When locking the refrigerator locking device 10 having the ring shaped cam 160, the door 12 is closed until the door seal 16 touches the refrigerator body 14. At that point the key 140 is inserted into the key slot 142 and the plunger member 42 is rotated clockwise. Inner shoulders 170 of the ears 120 contact the inclined surfaces 162. As the key 140 is further rotated, the plunger member 42 is drawn axially inwardly in order that the inner shoulders 170 may move along the inclined surfaces 162. This continues until the inner shoulders 170 of the ears 120 contact the walls 164 and rest in the dips 166. At this point the door 12 has moved inwardly a distance equal to the height of the ring-shaped cam 160 partially compressing the door seal 16. By utilizing the cam 160 compression of the door seal 16 can be quite accurately controlled. The controlled compression of the door seal 16 serves to improve the integrity of the sealing of the door 12 and provides for an adequate seal in the event of temperature changes to the door seal 16 which will affect its resiliency.

The refrigerator door locking device 10 may be secured to the refrigerator door 12 and the refrigerator body 14 by any suitable means including adhesive, rivets or fasteners (not shown) but preferably detents or tabs 172 as shown in FIG. 3. These tabs 172 expand inwardly from the base 36 of the elongated first mountable casing 30 and the base 64 of the second mountable casing 32. These tabs 172 may have any suitable configuration including but not limited to cylindrical shapes (not shown) which may mate with holes (not shown) in the refrigerator door 12 and body 14. Preferably the tabs 172 have a horizontally elongated shape including an outer knob portion 174 and an inner necked portion 176.

Figure 4:
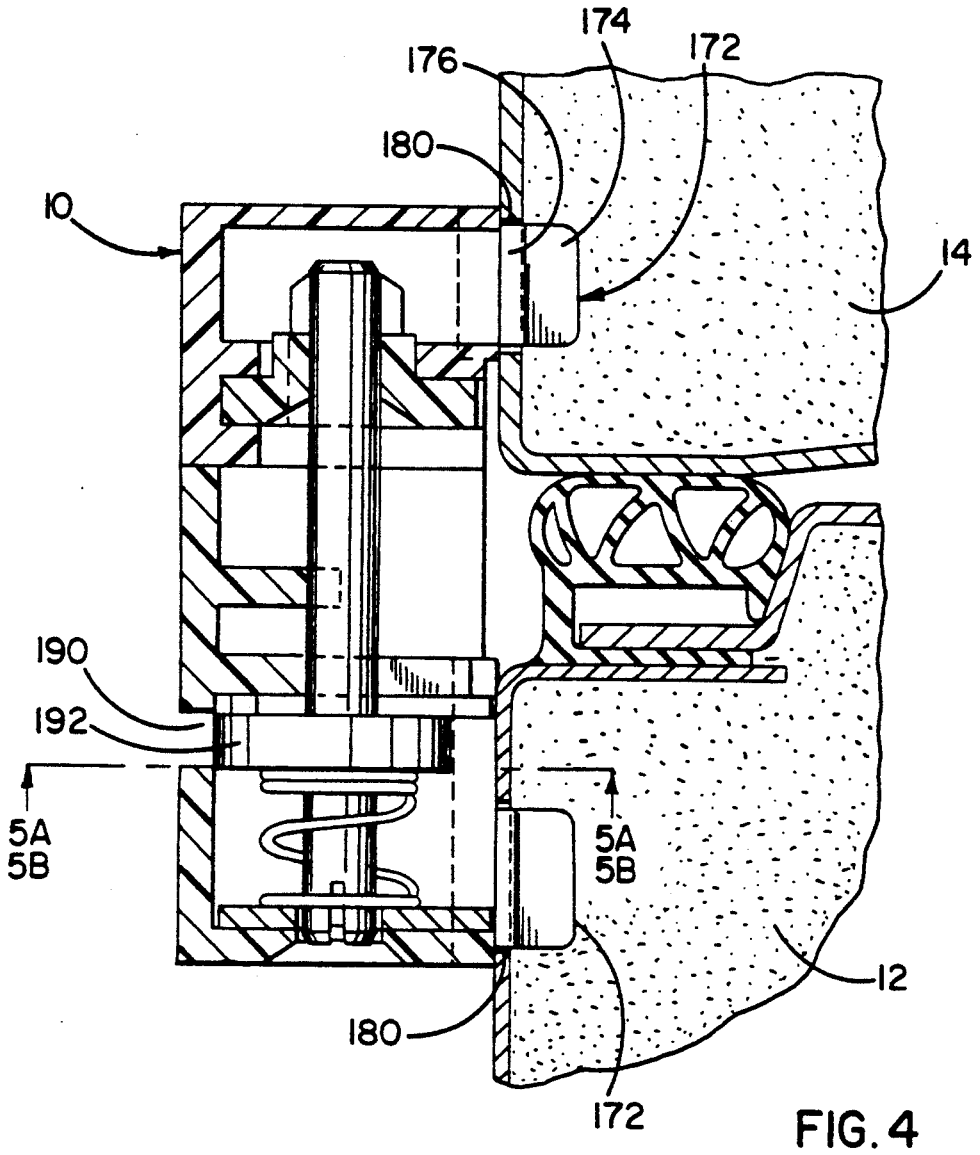
FIG. 4 is an enlarged cross-sectional view taken along line 4—4 of FIG. 1.

Referring to FIG. 4, in order to install the refrigerator door locking device 10 onto the refrigerator door 12 and the refrigerator body 14 the tabs 172 are aligned with elongated slots 180 in the refrigerator door 12 and the refrigerator body 14. The knob portion 174 of the tabs 172 are then inserted through the slots 180 until the necked portion 176 is located in the slots 180 and the knob portion 174 is located below the door 12 and the body 14.

Figure 5A:
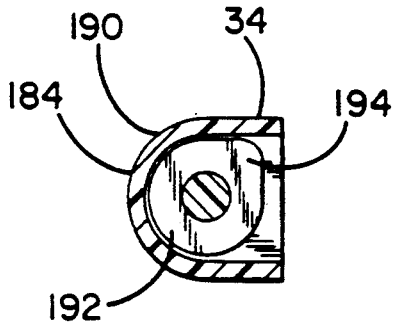
FIG. 5A is a fragmentary cross-sectional view taken along line 5A—5A of FIG. 4.
Figure 5B:
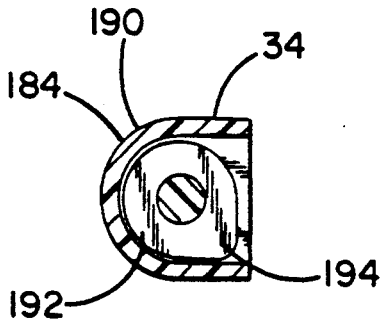
FIG. 5B is a fragmentary cross-sectional view taken along line 5B—5B of FIG. 4.

Referring to FIGS. 5A and 5B in order to determine whether the door locking device 10 is in a locked position when the door 12 is closed, indicator means 184 are provided. Any suitable means may be used to indicate that the refrigerator door lock 10 is in either a locked or unlocked position, but preferably the indicator means 184 comprise a viewing window 190 located in the housing 34 of the first mountable casing 30. The window 190 is aligned with the disk 44 in order that a disk periphery 192 may be viewed. The disk 44 of the plunger member 42 preferably has a lobe 194 which limits the rotation of the plunger member 42 to two extreme positions, one in which the device 10 is locked and the words "LOCKED" written on the periphery 192 appear through the window 190 and another in which the device 10 is unlocked and the words "UNLOCKED" written on the periphery 142 appear through the window 190.

By providing the key 140 with a tubular nose 200 as shown in FIG. 3A which fits between the casing opening 152 and the outer rod end 50 of the plunger member 42, the spring means 54 may push the key 140 out of the refrigerator door locking device 10 when the key 140 is inadvertently left in the locking device 10. This self-ejecting feature eliminates the possibility of inadvertently leaving the key 140 in the locking device 10. A child therefore may not inadvertently be locked into an abandoned freezer by another child.

Also, the provision of a plunger member 42 which is axially slidable within the first mountable casing 30 and which is biased by spring means 54 toward a rearward position, allows the ears 120 of the plunger member 42 to move outwardly in the event that the locking device 10 is left in a locked position when the door 12 is closed rather than having the ears 120 be sheared by the mutually engageable means 60. This feature eliminates the possibility of damage to the locking device 10 if the door 12 is shut in the locked position. The door locking device 10 is further provided with markings on the periphery 192 of the disk 44 of the plunger member 42 which may be viewed through the window 190 in the mountable casing 30, the locked or unlocked condition of the door locking device 10 can be readily apparent by merely viewing the position through the window 190. The possibility of damage to the locking device 10 by attempting to open the door 12 when the door locking device 10 is in the locked position is greatly reduced because the condition of the door locking device 10 can easily be read through the window 190.

The ring shaped cam 160 on the mutually engageable means 60, allows the door 12 to be accurately and precisely closed upon the refrigerator body 14 consistently deforming the door seal 16. By providing this consistent deformation of the door seal 16, the sealing of the door 12 is greatly improved. Also, the effects of variations in temperature which cause variations in the resiliency of the door seal 16 have less effect on the sealing of the door 12.

The provisions of the tabs 172 on the base 36 of the mountable casing 30 and on the base 64 of the second mountable casing 32, permit the door locking device 10 to be readily replaced by merely pulling the old door locking device 10 off and snapping a new door locking device 10 in its place. Also, a door-locking device 10 can be retrofitted to a door 12 by merely machining slots 180 or holes (not shown) into the refrigerator door 12 and the refrigerator body 14 and then popping the tabs 172 of the refrigerator door locking device 10 into the slots 180.

Since the key 140, with the tubular nose 200 and the blade 132, has no internal splines or other delicate features, the key 140 is quite durable.

Still other aspects, objects and advantages of the present invention can be obtained from a study of the Specification, the Drawings and the appended claims.

What is claimed is:

1. For use in association with a sealable door system that includes a door carrying a seal and a body, an improved locking device comprising, in combination;

an elongated first mountable casing adapted to be mounted to said door and having a longitudinal opening;

a plunger member having a centrally located disk, a projecting rod end extending from the disk in a first direction, and an outer rod end extending form the disk in a direction opposite from the first direction, said member slidably fit to said opening;

bayonet connector means located at said projecting rod end;

a catch means second mountable casing adapted to be mounted to said body;

spring means urging said plunger in said first direction and toward said catch means; and mutually engageable means carried by said catch casing for receiving said bayonet connector means.

2. The locking device of claim 1 further comprising a tapered chamfer surrounding said engageable means for directing said projecting rod end to align with said catch means.

3. The locking device of claim 1 further comprising indicator means for visually indicating locked or unlocked state of said locking device.

4. The locking device of claim 1 wherein said first casing, said plunger member, said catch casing and said mutually engageable means are molded plastic.

5. The locking device of claim 1 wherein said first casing and said catch casing have detent mounting means.

6. The locking device of claim 1 further comprising cam stop means for limiting rotation of said plunger member between "lock" and "unlock" positions".

7. The locking device of claim 1 wherein said outer rod end further comprises a slot for turning said plunger member if door is closed with said plunger member in "locked" position.

8. The locking device of claim 7 wherein said outer rod end is recessed within said first casing.

9. The locking device of claim 1 further comprising ejecting means for ejecting a key from said locking device.

10. The locking device of claim 9 wherein said ejecting means comprises a washer located between said spring means and said first casing and slidably fit over said outer rod end of said plunger member, said first casing having a casing opening to receive said outer rod end of said plunger member, said casing opening to be substantially larger than said washer opening whereby a tubular key may be fitted into said casing opening and seat against said washer, said spring means cooperating with said washer to eject said key.

11. For use in association with a sealable door system that includes a door carrying a seal and a body, an improved locking device comprising, in combination:

an elongated first mountable casing adapted to be mounted to said door and having a longitudinal opening;

a plunger member having a centrally located disk, a projecting rod end extending form the disk in a first direction, and an outer rod end extending from the disk in a direction opposite from the first direction, said member slidably fit to said opening;

bayonet connector means located a sad projecting rod end;

a catch means second mountable casing adapted to be mounted to said body;

spring means urging said plunger in said first direction and toward said catch means; and mutually engageable means carried by said catch casing for receiving said bayonet connector means; and pop out means associated with said plunger member for providing axial displacement of said plunger member if a door is closed with said plunger member in a locked position.

12. The locking device of claim 11 wherein said pop out means comprises said outer rod end being extendable through said longitudinal opening of said first casing.

13. For use in association with a sealable door system that includes a door carrying a seal and a body, an improved locking device comprising, in combination:

an elongated first mountable casing adapted to be mounted to said door and having a longitudinal opening;

a plunger member having a centrally located disk, a projecting rod end extending from the disk in a first direction, and an outer rod end extending from the disk in a direction opposite the first direction, said member slidably fit to said opening;

bayonet connector means located at said projecting rod end;

a catch means second mountable casing adapted to be mounted to said body;

spring means urging said plunger in said first direction and toward said catch means;

mutually engageable means carried by said catch casing for receiving said bayonet connector mean ;and pulling means associated with said engageable means for pulling said plunger member towards aid catch casing upon rotation of said plunger member.

14. The locking device of claim 13 further comprising a tapered chamfer surrounding said engageable means for directing said projecting rod end to align with said catch casing.

15. The locking device of claim 13 further comprising indicator means for visually indicating locked or unlocked state of said locking device.

16. The locking device of claim 13 wherein said pulling means is a rotary cam located on said catch casing.

17. The locking device of claim 13 wherein said first casing and the catch casing further comprise detent mounting means.

18. The locking device of claim 13 further comprising cam stop means for limiting said plunger member rotation between "lock" and "unlock" positions".

19. The locking device of claim 13 wherein said outer rod end further comprises a slot for turning said plunger member if a door is closed with said plunger member in "locked" position.

20. The locking device of claim 19 wherein said outer rod end is recessed with in said first casing.

* * * * *

UNITED STATES PATENT AND TRADEMARK OFFICE

CERTIFICATE OF CORRECTION

PATENT NO. : 5,275,029
DATED : January 4, 1994
INVENTOR(S) : Gary L. Myers

It is certified that error appears in the above-indentified patent and that said Letters Patent is hereby corrected as shown below:

Column 6, line 45, delete "5" and substitute therefor -- 50--.
Column 9, line 51, delete "sad" and substitute therefor --said --.
Column 10, line 30, add "s" to the word "mean"--;
line 33, delete "aid" and substitute therefor -- said --.
line 55, delete "with in" and substitute therefor -- within --.

Signed and Sealed this

Twentieth Day of September, 1994

*Attest:*

Bruce Lehman

BRUCE LEHMAN

*Attesting Officer*

*Commissioner of Patents and Trademarks*